United States Patent [19]

Brink

[11] Patent Number: 4,850,748

[45] Date of Patent: Jul. 25, 1989

[54] LIFTING DEVICE CONNECTED TO TRACTOR SCOOP

[75] Inventor: Lawrence J. Brink, Worthington, Pa.

[73] Assignee: Jennmar Corporation, Pittsburgh, Pa.

[21] Appl. No.: 133,519

[22] Filed: Dec. 16, 1987

[51] Int. Cl.[4] ..... E21D 15/00

[52] U.S. Cl. ..... 405/303; 405/288; 299/64

[58] Field of Search ..... 405/303, 146, 151, 290, 405/291, 293; 299/33, 64; 254/8 B, 133 A

[56] References Cited

U.S. PATENT DOCUMENTS

| | | | |
|---|---|---|---|
| 2,772,871 | 12/1956 | Caine | 405/298 X |
| 4,690,378 | 9/1987 | Jarman et al. | 254/8 B |
| 4,756,509 | 7/1988 | Unger et al. | 254/8 B |

*Primary Examiner*—Dennis L. Taylor
*Assistant Examiner*—Arlen L. Olsen
*Attorney, Agent, or Firm*—Stanley J. Price, Jr.

[57] ABSTRACT

A lifting device adapted to be connected to a tractor scoop includes a plurality of first lifting members adapted to be positioned in overlying relation with a bottom wall of the scoop. One end of each first lifting member is adapted to be pivotally connected to the rear wall of the scoop, and the second free end of each first lifting member extends forward of the open front portion of the scoop. A second lifting member is pivotally connected to each first lifting member, and each second lifting member is also adapted to be pivotally connected to a horizontally movable pusher member positioned within the scoop. A support member or saddle is pivotally secured to the free end of each first lifting member, and a roof support member is supported by the plurality of saddles. The roof support member is raised into abutting contact with a mine roof above the scoop by moving the pusher member positioned in the scoop horizontally towards the open front of the scoop. As the pusher member is moved, the second lifting members pivot in an upward arcuate path, thereby pivoting the first lifting members to which they are connected in an upward arcuate path. The pusher member is moved horizontally towards the open front of the scoop until the roof support member on the support saddles is brought into abutting contact with the mine roof.

18 Claims, 3 Drawing Sheets

LIFTING DEVICE CONNECTED TO TRACTOR SCOOP

BACKGROUND OF THE INVENTION

1. Field of the invention

This invention relates to a lifting device for use in underground mining operations, and more particularly, to a lifting device which is adapted to be connected to a tractor scoop having a movable pusher member positioned therein and pivoted in an upward path upon movement of the pusher member to bring a roof support member positioned on the lifting device into abutting contact with a mine roof.

2. Description of the Prior Art

In the field of underground mining it is well known to support a mine roof formed as material is removed from the mine face by means of roof support members or crossbeams. The roof support members are usually raised into abutting contact with the mine roof and maintained in position by suitable blocking. After the roof support members are raised into abutting contact with the mine roof and blocked in position, the roof support members are anchored to the mine roof by conventional roof bolts.

The hand setting of roof support members by mine personnel presents a hazardous condition since hand setting requires these individuals to work under unsupported roof, and the danger of mine roof collapse is an ever present one.

In order to protect mine personnel from hazards associated with hand setting roof support members, U.S. Pat. No. 2,772,871 discloses an apparatus lifting roof support members into abutting contact with a mine roof which is connected with a continuous mining machine. The roof support member lifting apparatus includes a pair of elevating beams positioned longitudinally along the top of the continuous mining machine on each side of the mining machine longitudinal conveyor. Each elevating beam has an end portion pivotally connected to the rear end of the mining machine, and the opposite ends of the elevating beams extend towards the front end of the machine. A roof support member is positioned on saddles connected with the opposite ends of the pair of elevating beams so that the roof support member lies transverse to the longitudinal axis of the machine. Hydraulic cylinders connected between the mining machine and each elevating beam are operable to raise the elevating beams to bring the roof support member into abutting contact with the mine roof.

While it has been suggested by the prior art to mount a roof support member lifting apparatus to a continuous mining machine and hydraulically lift a roof support member positioned on the lifting apparatus into abutting contact with a mine roof, there is a need for a lifting device capable of raising a roof support member into abutting contact with a mine roof that is adapted to be easily connected to a conventional mine scoop tractor. The lifting device must be capable of supporting a roof support member and raising the roof support member into abutting contact with the mine roof upon horizontal movement of a pusher member positioned within the tractor scoop. The lifting device must be operable to raise a roof support member into abutting contact with the mine roof above and forward of the scoop tractor to eliminate the safety hazards present when these roof support members are manually raised into position by mine personnel.

SUMMARY OF THE INVENTION

In accordance with the present invention there is provided a lifting device adapted to be connected to a tractor scoop that includes first lifting means having an end portion and a second, free end portion. The first lifting means is adapted to be positioned in overlying relation with a bottom wall of a tractor scoop, with the end portion of the first lifting means adapted to be pivotally connected to a rear wall portion of the tractor scoop. The second, free end portion of the first lifting means is arranged to extend forwardly of an open front portion of the tractor scoop. A support means is pivotally connected to the second, free end portion of the first lifting means. Second lifting means is provided having a first end portion and a second end portion. The second lifting means first end portion is adapted to be pivotally connected to a horizontally movable pusher member positioned within the tractor scoop, and the second lifting means second end portion is pivotally connected with the first lifting means intermediate the first lifting means end portions. The second lifting means first end portion is adapted to be moved substantially horizontally when connected to the pusher member to pivot the second, free end portion of the first lifting means in a vertical arcuate path.

Further in accordance with the present invention, there is provided a method for raising a roof support member into abutting contact with a mine roof that includes the steps of placing a roof support member on a support means pivotally connected with a second, free end portion of a first lifting means. The first lifting means is positioned in overlying relation with a bottom wall of a tractor scoop with an end portion of the first lifting means adapted to be pivotally connected to a rear wall portion of the tractor scoop. The method further includes the step of moving a pusher member positioned in the tractor scoop horizontally in a direction forward of a tractor scoop rear wall portion to move the second, free end portion of the first lifting means with the roof support beam positioned thereon in an upward arcuate path. The pusher member is moved horizontally in a direction forward of the tractor scoop rear wall portion to move the roof support member into abutting relation with a mine roof.

Additionally in accordance with the present invention, there is provided a tractor scoop having a lifting device positioned therein which includes a tractor scoop having a bottom wall portion and a pair of spaced, substantially parallel side wall portions extending upwardly from the bottom wall portion. A tractor scoop rear wall portion extends upwardly from the bottom wall portion and is connected to the pair of side wall portions. The rear wall portion and the pair of side wall portions form a tractor scoop material receiving portion. A pusher member is positioned within the tractor scoop material receiving portion, and means is provided for selectively moving the pusher member within the tractor scoop material receiving portion in a substantially horizontal path. First lifting means is provided having an end portion and a second, free end portion. The first lifting means is positioned in overlying relation with the tractor scoop bottom wall portion, and the first lifting means end portion is pivotally connected to the tractor scoop rear wall portion. Second lifting means is also provided having a first end portion and a second end portion. The second lifting means first end portion is pivotally connected to the horizontally movable pusher member, and the second lifting means second end portion is pivotally connected with the first lifting means intermediate the first lifting means end portions. The second lifting means first end portion is moved substantially horizontally as the pusher member is moved within the tractor scoop material receiving portion to raise the first lifting means second, free end portion in an upward arcuate path and move a roof support member positioned on the first lifting means second, free end portion into abutting relation with a mine roof.

Accordingly, the principal object of the present invention is to provide a lifting device which may be easily connected to a tractor scoop and selectively raised and lowered relative to the tractor scoop upon movement of a tractor scoop pusher member in a preselected horizontal direction.

Another object of the present invention is to provide a lifting device for raising support members into abutting contact with a mine roof which may be connected to a scoop tractor when it is desired to provide roof support and easily disconnected when not in use to allow the scoop tractor to perform its normal material handling duties.

A further object of the present invention is to provide a lifting device operable to safely and automatically raise a support member into abutting contact with a mine roof without requiring the assistance of mine personnel during the support member raising operation.

These and other objects of the present invention will be more completely disclosed and described in the following specification, the accompanying drawings and the appended claims.

DESCRIPTION OF THE PREFERRED EMBODIMENTS

Figure 1:
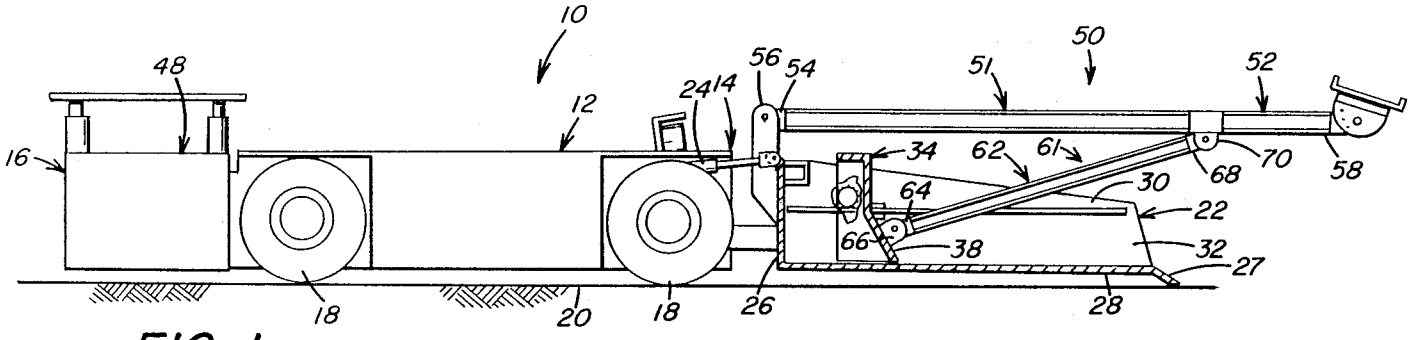
FIG. 1 is a view in side elevation of a conventional scoop tractor, with the tractor scoop shown in section to illustrate a lifting device adapted to be pivotally connected to the tractor scoop and operable to raise a roof support member or crossbeam into abutting contact with a mine roof above and forward of the scoop tractor.
Figure 2:
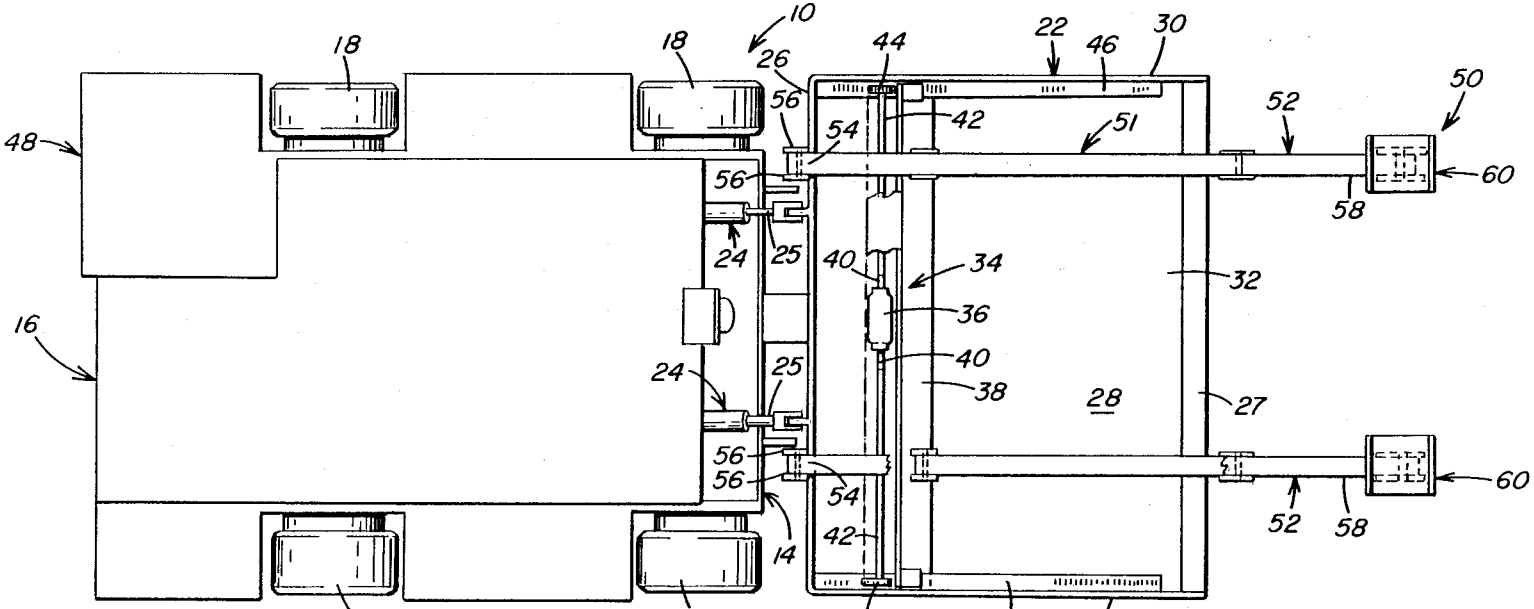
FIG. 2 is a top plan view of the scoop tractor of FIG. 1, illustrating the lifting device first lifting members positioned in overlying relation with the tractor scoop and pivotally connected to the tractor scoop rear wall.

Referring to the drawings, and particularly to FIGS. 1 and 2, there is illustrated a scoop tractor generally designated by the numeral 10 for use in underground mining operations or in any type of underground excavation work. Scoop tractor 10 and its operation are themselves known in the art. Scoop tractor 10 includes a bucket or scoop operable to receive loose material deposited on a mine floor. Positioned within the scoop is a movable blade or pusher member, and removal of the loose material from the scoop is accomplished by horizontal movement of the pusher member from a position adjacent the scoop rear wall in a direction towards the open front of the scoop.

As seen in FIGS. 1 and 2, scoop tractor 10 includes a mobile body portion 12. The mobile body portion 12 has a front end 14 and a rearward end 16. A plurality of ground engaging traction wheels 18 are mounted to the mobile body portion 12 of scoop tractor 10 and are operable to propel mobile body portion 12 along a mine floor, such as mine floor 20 illustrated in FIG. 1.

A tractor scoop or bucket generally designated by the numeral 22 is positioned forwardly of the front end 14 of mobile body portion 12. The connection between tractor scoop 22 and mobile body portion 12 is schematically illustrated in FIGS. 1 and 2, since scoop tractor 10 including mobile body portion 12 and tractor scoop 22 is itself known in the art. Tractor scoop 22 may be pivoted vertically relative to mobile body portion 12 by a pair of pivoting cylinders generally designated by the numerals 24. The pair of pivoting cylinders 24 are connected between the front end 14 of mobile body portion 12 and the rear wall 26 of tractor scoop 22. Pivoting cylinders 24 include extensible rods 25 operable upon movement from a retracted position to an extended position to pivot tractor scoop 22 in a downward arcuate path and bring the forward lip member 27 of tractor scoop 22 into contact with mine floor 20. Conversely, upward pivotal movement of tractor scoop 22 is accomplished by movement of extensible rods 25 from an extended position to a retracted position.

Tractor scoop 22 includes a bottom wall 28, the lip member 27 extending and angularly spaced from bottom wall 28, a pair of spaced side walls 30 which extend upwardly from bottom wall 28, and rear wall 26. Rear wall 26 also extends upwardly from bottom wall 28 and is connected with the pair of side walls 30. The pair of spaced side walls 30 and rear wall 26 form a material receiving portion within the interior of tractor scoop 22. As seen in FIGS. 1 and 2, tractor scoop 22 also includes an open front portion 32.

Positioned within tractor scoop 22 is a blade or pusher member generally designated by the numeral 34. Pusher member 34 is also known in the art and is described herein only as it relates to the present invention. As seen in FIGS. 1 and 2, pusher member 34 is positioned for movement in a generally horizontal path within tractor scoop 22 between tractor scoop rear wall 26 and tractor scoop open front portion 32.

The horizontal movement of blade or pusher member 34 within tractor scoop 22 is accomplished by a motor schematically illustrated by the numeral 36 which is secured to pusher member 34 rearwardly of pusher member front wall 38. Motor 36 includes a pair of output shafts 40 each connected by suitable means to an extension shaft 42. A multiple tooth sprocket 44 is connected with the end of each extension shaft 42. As known in the art, the plurality of teeth on each sprocket 44 are arranged to engage a rack member 46 positioned on the inside wall of tractor scoop side wall 30. Horizontal movement of pusher member 34 within tractor scoop 22 between rear wall 26 and open front portion 32 is accomplished by energizing motor 36 and rotating the pair of extension shafts 42 to allow the pair of sprockets 44 which engage the rack members 46 to advance on the rack members 46. It should be understood that rotation of the motor 36 output shafts 40 in a preselected angular direction will cause pusher member 34 to move horizontally within tractor scoop 22 from a position adjacent rear wall 26 towards tractor scoop 22 open front portion 32. Rotation of the motor 36 output shafts 40 in an opposite angular direction will cause pusher member 36 to move horizontally within tractor scoop 22 from a position adjacent open front portion 32 towards tractor scoop 22 rear wall 26. It should be further understood that scoop tractor 10 includes suitable controls for allowing the scoop tractor operator to position pusher member 34 at any desired position within tractor scoop 22.

Although apparatus for moving pusher member 34 horizontally within tractor scoop 22 is specifically described herein, it should be understood that pusher member 34 may be moved horizontally within tractor scoop 22 by other suitable means also known in the art. For example, cylinder assemblies may be connected between pusher member 34 and either the rear wall 26 of tractor scoop 22 or the front end 14 of mobile body 12 and operated to move pusher member 34 horizontally within tractor scoop 22.

Scoop tractor 10 includes sources of power known in the art and is capable of being operated from an operating station 48 which includes suitable controls for advancing mobile body portion 12 within a mine along the floor of the mine, tilting tractor scoop 22 in a preselected angular direction relative to mobile body portion 12, and operating pusher member 34.

Scoop tractor 10 is operable to advance along a mine floor and collect loose material within the material receiving portion of tractor scoop 22. After a desired amount of loose material is collected within tractor scoop 22, scoop tractor 10 is driven to another location and the loose material is discharged from the material receiving portion of tractor scoop 22 by moving pusher member 34 towards the open front portion 32 of tractor scoop 22.

In accordance with the present invention, there is provided a lifting device generally designated by the numeral 50 which is adapted to be connected with the tractor scoop 22 of scoop tractor 10 and operated to raise a support member or crossbeam into abutting contact with a mine roof above and forward of scoop tractor 10. Since the support member or crossbeam is positioned on lifting device 50 forward of the open front portion 32 of tractor scoop 22, it can be seen in FIGS. 1 and 2 that a scoop tractor operator positioned at operating station 48 is far removed from lifting device 50 and protected from exposure to an unsupported mine roof.

As seen in FIGS. 1 and 2, the lifting device generally designated by the numeral 50 includes first lifting means 51. First lifting means 51 includes a pair of first lifting members 52. Each first lifting member 52 includes an end portion 54 pivotally connected between a pair of upright members or lugs 56 secured to tractor scoop 22 rear wall 26. Each first lifting member 52 also includes a second, free end portion 58. A support member or saddle generally designated by the numeral 60 is pivotally connected to the second, free end portion 58 of each first lifting member 52. Each first lifting member 52 has an overall length sufficient to allow support member 60 to be positioned forward of the open front portion 32 of scoop 22. As will be described later in greater detail, a support member or crossbeam is positioned on the pair of support members 60 and moved upwardly into abutting contact with a mine roof above and forward of scoop tractor 10 upon operation of lifting device 50. It should be understood that although a pair of first lifting members 52 are illustrated in the Figures, any desired number of first lifting members 52 maybe utilized without departing from this invention. In addition, a support member or saddle 60 is pivotally connected to the free end portion 58 of each first lifting member 52 utilized.

The lifting device generally designated by the numeral 50 also includes second lifting means 61. Second lifting means 61 includes a pair of second lifting members each designated by the numeral 62. As seen in FIG. 1, a second lifting member 62 is positioned between tractor scoop 22 pusher member 34 and each first lifting member 52. Each second lifting member 62 includes a first end portion 64 connected for pivotal movement between a pair of lugs 66 (one shown) secured to the front wall 38 of pusher member 34. Each second lifting member 62 also includes a second end portion 68 connected for pivotal movement between a pair of lugs 70 (one shown) secured to first lifting member 52.

Although a specific pivotal connection between first lifting member 52 and second lifting member 62 is described herein, it should be understood that any suitable means for pivotally connecting first and second lifting members 52, 62 may be utilized without departing from this invention. Similarly, any suitable means for pivotally connecting second lifting member 62 first end portion 64 to pusher member 34 and first lifting member 52 end portion 54 to tractor scoop rear wall 26 may be utilized.

Figure 3:
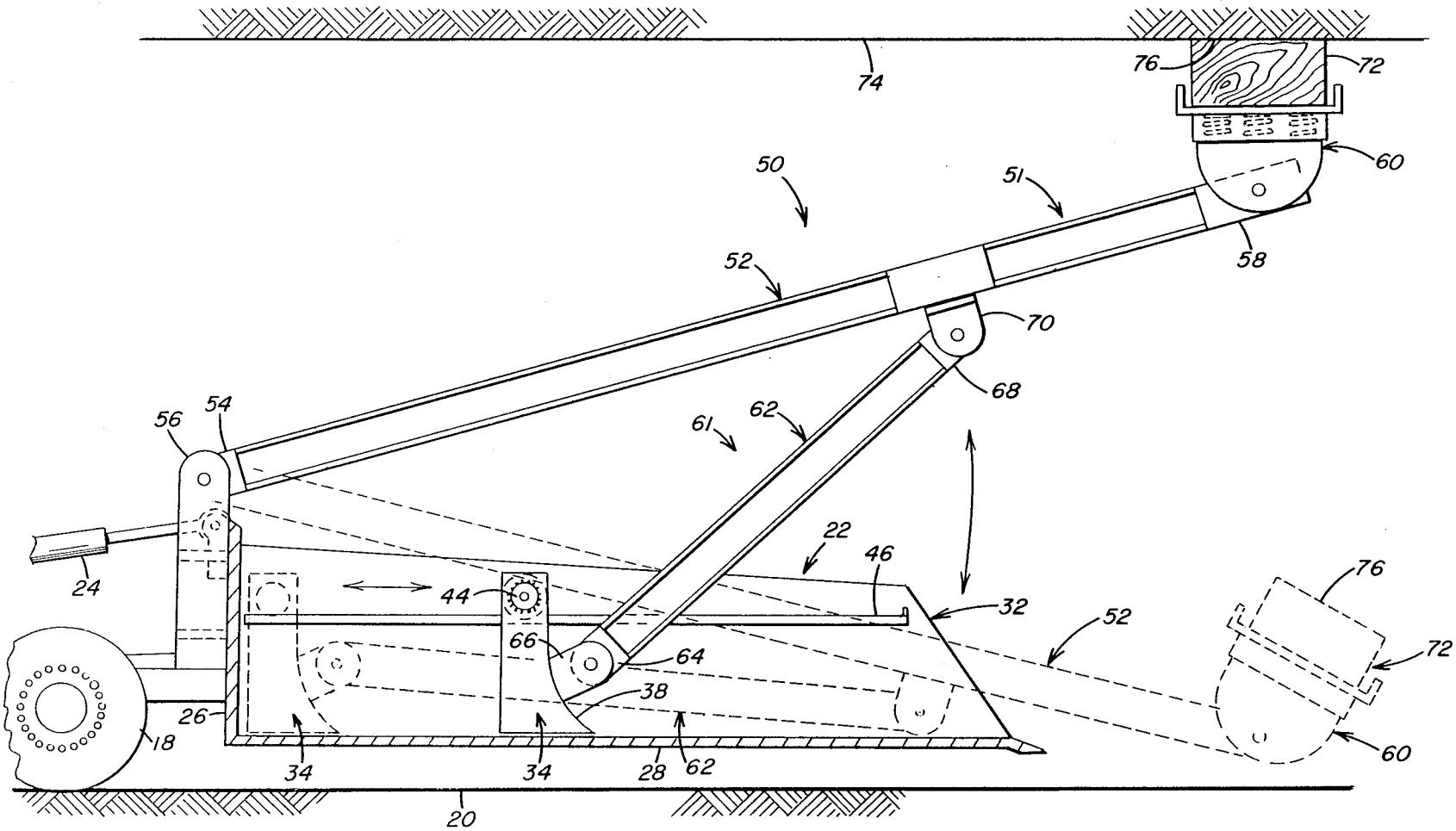
FIG. 3 is a fragmentary, partial sectional view in side elevation of the tractor scoop and lifting device of FIG. 1, illustrating the lifting device pivoted in an upward arcuate path to place a roof support member in abutting contact with a mine roof from a lowered position illustrated in phantom.

As seen in FIGS. 1–3, pivotal movement of the plurality of first lifting members 52 in either an upward or downward arcuate path relative to tractor scoop 22 is accomplished by the horizontal movement of pusher member 34 in a preselected direction between tractor scoop rear wall 26 and open front portion 32. Specifically, FIG. 3 illustrates the plurality of first lifting members 52 in a downward position shown in phantom, and in a raised position for placing a support member of crossbeam 72 in abutting contact with a mine roof 74.

As seen in FIG. 3, the pair of first lifting members 52 (one shown) are illustrated in phantom in a lowered position. With the pair of first lifting members 52 in a lowered position, a support member or crossbeam 72 is placed on the pair of support members 60. Horizontal movement of pusher member 34 from the position illustrated in phantom adjacent the rear wall 26 of tractor scoop 22 in a direction towards tractor scoop 22 open front portion 32 causes the pair of second lifting members 62 pivotally connected between pusher member 34 and the pair of first lifting members 52 to pivot vertically to raise the second end portions 68 of second lifting members 62 in an upward arcuate path relative to tractor scoop 22 bottom wall 28. Since the pair of first lifting members 52 are pivotally connected at their end portions 54 to tractor scoop rear wall 26, the upward pivotal movement of the second end portions 68 of second lifting members 62 will cause the pair of first lifting members 52 to pivot in an upward arcuate path.

Pusher member 34 is moved horizontally within tractor scoop 22 in a forward direction towards open front portion 32 until the top surface 76 of support member 72 contacts mine roof 74. After support member 72 is brought into abutting contact with mine roof 74, support member 72 may be anchored to mine roof 74 by any suitable means. If desired, support member 72 may be secured to mine roof 74 by means of conventional roof bolts as lifting device 50 maintains support member 72 in abutting contact with mine roof 74. If desired, support member 72 may be maintained in abutting contact with mine roof 74 by means of standard support blocking in preparation for receiving roof bolts at a later time.

After roof support member 72 is raised into abutting contact with mine roof 74 and either anchored to mine roof 74 or blocked in position, pusher member 34 is moved horizontally within tractor scoop 22 in a direction towards rear wall 26 to lower the plurality of first and second lifting members 52, 62. Normally, tractor scoop 22 is pivoted in a downward direction to bring scoop 22 forward lip member 27 into abutting contact with mine floor 20 prior to raising support member 72 into abutting contact with mine roof 74. This prevents inadvertent movement of scoop 22 during the support member lifting phase and also provides mine floor support as the support member is brought into contact with the mine roof.

Figure 4:
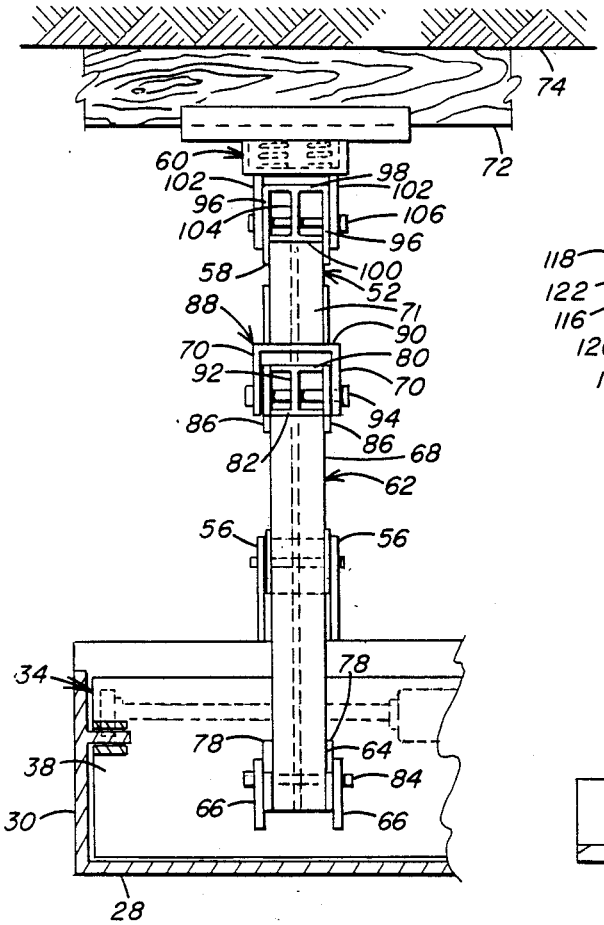
FIG. 4 is a fragmentary, front elevational view of a portion of the lifting device in a raised position to place a roof support member in abutting contact with a mine roof.

Referring to FIG. 4, there is illustrated in greater detail the connection between first and second lifting members 52, 62, and the connection between second lifting member 62 and pusher member 34 front wall 38. First and second lifting members 52, 62 are shown in a raised position with a portion of roof support member 72 in abutting contact with mine roof 74.

As seen in FIG. 4, the first end portion 64 of second lifting member 62 is connected for vertical pivotal movement to the front wall 38 of pusher member 34. Second lifting member 62 is formed from a preselected length of standard I beam material, and a pair of plates 78 are secured between the top and bottom flanges 80, 82 of second lifting member 62 at first end portion 64. The pair of plates 78 are positioned between the pair of lugs 66 secured to the front wall 38 of tractor scoop 22. The pairs of plates 78 and lugs 66, and the web 92 of second lifting member 62 each have aligned holes therethrough for receiving a pin member 84. Although not specifically illustrated in FIG. 4, the pair of lugs 66 may be secured to a base plate member, and the base plate member secured to pusher member 34 front wall 38.

The second end portion 68 of second lifting member 62 is pivotally connected to first lifting member 52 in similar fashion. A pair of plates 86 are secured between the top and bottom flanges 80, 82 of second lifting member 62 at second end portion 68. A generally U-shaped retaining member 88 having a base member 90 and the pair of lugs 70 extending therefrom is secured to the bottom flange 98 of first lifting member 52. The second end portion 68 of second lifting member 62 is positioned between the pair of lugs 70. The pairs of plates 86 and lugs 70, and the web 92 of second lifting member 62 each include aligned holes therethrough for receiving a pin member 94. With this arrangement, second lifting member 62 is pivotally connected to both first lifting member 52 and the front wall 38 of pusher member 34.

As further illustrated in FIG. 4, the support member or saddle 60 previously described is connected for pivotal movement to the free end portion 58 of first lifting member 52. First lifting member 52 is also formed from a preselected length of I beam material, and includes a pair of plates 96 secured to the top and bottom flanges 98, 100 of first lifting member 52 at free end portion 58. Support member 60 includes a pair of spaced apart lugs 102 arranged to receive the free end portion 58 of first lifting member 52. The pairs of plates 96 and lugs 102, and the web 104 of first lifting member 52 each include aligned holes therethrough for receiving a pin member 106.

Figure 5:
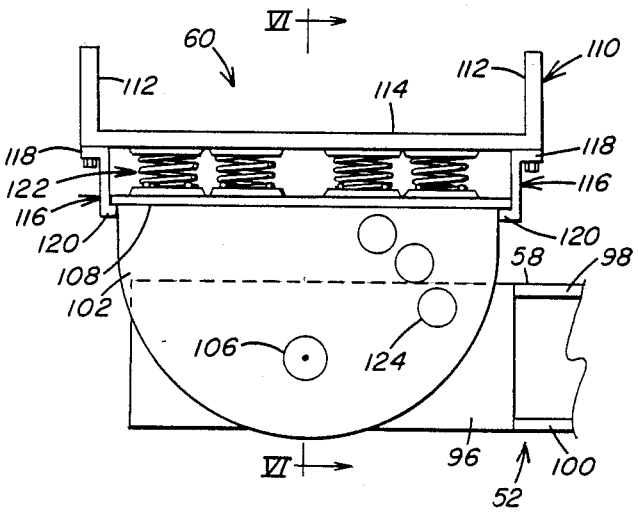
FIG. 5 is a fragmentary view in side elevation of a support member or saddle connected for pivotal movement to the free end of the lifting device first lifting member, illustrating the arrangement for maintaining the support member in an angled position relative to the first lifting member.
Figure 6:
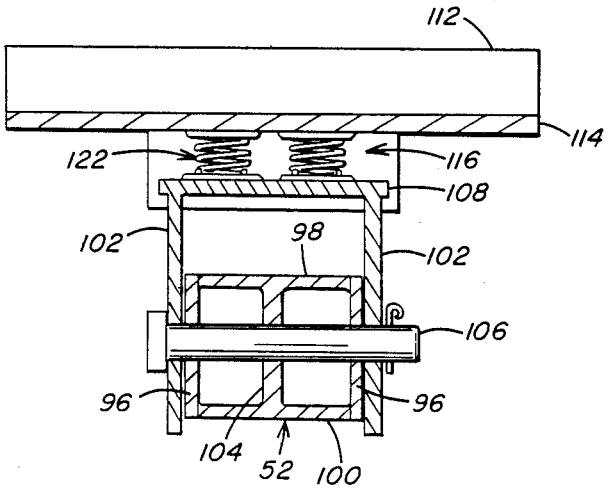
FIG. 6 is a sectional view taken along line VI—VI of FIG. 5.

Referring to FIGS. 5 and 6, there is illustrated in further detail a support member or saddle 60 and its connection to the free end portion 58 of first lifting member 52. As seen in FIGS. 5 and 6, support member 60 includes the pair of lugs 102 previously described secured for pivotal movement to the free end portion 58 of first lifting member 52 by means of pin member 106. Each of the lugs 102 is secured to a plate member 108, and the pair of lugs 102 are spaced apart a sufficient distance to receive the free end portion 58 of first lifting member 52.

Support member 60 also includes a generally U-shaped support saddle 110. The support saddle 110 includes a pair of spaced apart, generally parallel upright plate members 112 secured to a plate member 114. The pair of upright plate members 112 are spaced apart a sufficient distance to receive a portion of a roof support member or crossbeam and allow the roof support member to rest on plate member 114.

As seen in FIGS. 5 and 6, the plate member 108 having the spaced apart lugs 102 secured thereto is connected with the generally U-shaped support saddle 110 by means of a pair of S-shaped members 116. Each of the S-shaped members 116 includes an upper lip portion 118 secured to plate member 114, and a lower lip portion 120 for supporting a portion of plate member 108. Positioned between the plate members 114,108 is a resilient means schematically illustrated and generally designated by the numeral 122. Resilient means 122 maintains plate member 108 in pressure contact with the lower lip portions 120 of S-shaped members 116 and permits relative movement between plate member 114 and plate member 108.

Resilient means 122 is operable to bring substantially the entire top surface 76 of roof support member or crossbeam 72 into abutting contact with an uneven mine roof 74 as the plurality of first lifting members 52 are raised in an upward arcuate path. It can be seen that if the surface of mine roof 74 is uneven in a direction parallel with the length of roof support member 72, only a portion of roof support member 72 top surface 76 will be brought into abutting contact with uneven mine roof 74 as the pair of first lifting members 52 are simultaneously raised the same vertical distance. Since resilient means 122 permits relative vertical movement between the plate members 108, 114 of each support member 60, a portion of roof support member 72 may first be brought into contact with an uneven mine roof 74, and the forces exerted on the first and second lifting members as the remainder of the roof support member 72 is raised into contact with uneven mine roof 74 will be absorbed by resilient means 122.

Although resilient means 122 is illustrated in FIGS. 4 through 6 as being positioned between the plate members 108, 114 of each support member 60, it should be understood that resilient means such as resilient means 122 may be connected between second lifting member 62 second end portion 68 and first lifting member 52 with similar results. As previously described, resilient means 122 is schematically illustrated in the figures, and any type of resilient means or force absorbing means may be utilized without departing from this invention.

As further illustrated in FIG. 5, the pair of lugs 102 (one shown) secured to plate member 108 of each support member 60 include a plurality of openings 124. The openings 124 in the pair of lugs 102 are aligned to receive a pin member (not shown). Since support member 60 is pivotally connected to the free end portion 58 of first lifting member 52, a pin member may be inserted through pairs of aligned openings 124 to maintain plate member 114 of support member 60 at a preselected angle relative to first lifting member 52 top flange 98. The angular displacement of plate member 114 from top flange 98 may be varied and is selected to provide that, when roof support member 72 is brought into abutting contact with mine roof 74, the top surface 76 of roof support member 72 is parallel with mine roof 74. This eliminates the need for rolling roof support member 72 in order to bring roof support member top surface 76 into full abutting contact with mine roof 74.

Although the plurality of first and second lifting members 52, 62 are described herein as being formed from I-shaped beam members, it should be understood that the plurality of first and second lifting members 52, 62 may be formed from any suitable structural material. For example, first and second lifting members 52, 62 may each be made from pipe-like members if desired. If first and second lifting members 52, 62 are made from material other than I-shaped beam members, it is seen that the configuration of the connecting apparatus between these respective members, and the apparatus for connecting second lifting member 62 to pusher member 34 will be modified as required. In addition, although the invention is described herein as including a plurality of first and second lifting members 52, 62, it should be understood that a single first lifting member 52 and second lifting member 62 may be utilized if desired.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A lifting device for use as an accessory with a tractor scoop having a bottom wall, a rear wall portion, and a horizontally movable pusher member therein comprising, first lifting means having an end portion and a second, free end portion, said first lifting means adapted to be positioned in overlying relation with said tractor scoop bottom wall with said first lifting means end portion adapted to be pivotally connected to said tractor scoop rear wall portion, support means pivotally connected to said second free end portion of said first lifting means, second lifting means having a first end portion and a second end portion, said second lifting means first end portion adapted to be pivotally connected to said horizontally movable pusher member positioned within said tractor scoop and said second lifting means second end portion pivotally connected with said first lifting means intermediate said first lifting means end portions, and said second lifting means first end portion adapted to be moved substantially horizontally to pivot said first lifting means second, free end portion in a vertical arcuate path.

2. A lifting device for use as an accessory with a tractor scoop as set forth in claim 1 in which said first lifting means includes, a plurality of first lifting members each having said end portion and said second free end portion, and said plurality of first lifting members each adapted to be positioned in overlying relation with said bottom wall of said tractor scoop with said end portion of each of said plurality of first lifting members adapted to be pivotally connected with said tractor scoop rear wall portion.

3. A lifting device for use as an accessory with a tractor scoop as set forth in claim 2 in which said lifting means includes, a plurality of second lifting members each having said first end portion and said second end portion, and one of said plurality of second lifting members positioned between one of said plurality of first lifting members and said horizontally movable pusher member with said second lifting member first end portion adapted to be pivotally connected with said pusher member and said second lifting member second end portion pivotally connected with said one of said plurality of first lifting members intermediate said first lifting member end portions.

4. A lifting device for use as an accessory with a tractor scoop as set forth in claim 2 in which said support means includes, a plurality of support members, one said support member pivotally connected with said second free end portion of one of said plurality of first lifting members, said plurality of support members arranged to support a beam member positioned transverse to a longitudinal axis of said tractor scoop, and said beam member supported by said plurality of support members being raised into abutting contact with a roof above said tractor scoop as said plurality of first lifting members second free end portions are pivoted in an upward arcuate path.

5. A lifting device for use as an accessory with a tractor scoop as set forth in claim 4 in which, each said support member pivotally connected to said second free end portion of said first lifting member includes adjustment means for maintaining said support member at a preselected angle relative to said first lifting member.

6. A lifting angle for use as an accessory with a tractor scoop as set forth in claim 1 in which, said tractor scoop includes an open front portion opposite said tractor scoop rear wall portion, and said first lifting means second free end portion is adapted to extend forwardly of said tractor scoop open front portion.

7. A lifting device for use as an accessory with a tractor scoop as set forth in claim 1 in which, said pusher member is positioned within said tractor scoop for horizontal movement between said tractor scoop rear wall portion and a tractor scoop open front portion, said first lifting means second free end portion is moved in a downward arcuate path by said second lifting means as said pusher member is moved horizontally in a direction towards said tractor scoop rear wall portion, and said first lifting means second free end portion is moved in an upward arcuate path by said second lifting means as said pusher member is moved horizontally in a direction towards said tractor scoop open front portion.

8. A lifting device for use as an accessory with a tractor scoop as set forth in claim 1 which includes, resilient means between said support means and said first lifting means second free end portion for permitting movement of said first lifting means second free end portion in an upward arcuate path relative to said support means after a portion of a beam member positioned on said support means is brought into abutting contact with a roof above said tractor scoop.

9. A lifting device for use as an accessory with a tractor scoop as set forth in claim 1 in which, said first lifting means and said second lifting means are each formed from an I beam material.

10. A lifting device for use as an accessory with a tractor scoop as set forth in claim 1 in which, said support means has a generally U-shaped configuration for receiving a portion of said beam member.

11. A method for raising a roof support beam into abutting contact with a mine roof comprising the steps of, placing a roof support beam on a support means connected with a second, free end portion of a first lifting means, said first lifting means adapted to be positioned in overlying relation with a bottom wall of a tractor scoop with an end portion of said first lifting means adapted to be pivotally connected to a rear wall portion of said tractor scoop, said first lifting means being pivotally connected by mechanical linkage to a pusher member positioned in said tractor scoop, moving said pusher member positioned in said tractor scoop horizontally in a direction forward of said tractor scoop rear wall portion to move said mechanical linkage and thereby move said first lifting means second free end portion with said roof support beam positioned thereon in an upward arcuate path, and moving said pusher member horizontally in said direction forward of said tractor scoop rear wall portion to move said roof support member into abutting relation with a mine roof.

12. A method for raising a roof support beam into abutting contact with a mine roof as set forth in claim 11 including, positioning said first lifting means in overlying relation with said tractor scoop bottom wall so that said first lifting means is substantially parallel with a longitudinal axis of said tractor scoop.

13. A method for raising a roof support beam into abutting contact with a mine roof as set forth in claim 11 including, extending said second, free end portion of said first lifting means forward of an open front portion of said tractor scoop.

14. A method for raising a roof support beam into abutting contact with a mine roof as set forth in claim 11 including, placing said roof support beam on said support means so that said roof support beam lies transverse to a longitudinal axis of said tractor scoop.

15. A method for raising a roof support beam into abutting contact with a mine roof as set forth in claim 11 including the further steps of, pivotally connecting said support means to said second free end portion of said first lifting means, and providing said support means with adjustment means for maintaining said support means at a preselected angle relative to said first lifting means.

16. A tractor scoop having a lifting device positioned therein comprising, a tractor scoop, said tractor scoop having a bottom wall portion and a pair of spaced, substantially parallel side wall portions extending upwardly from said bottom wall portion, a rear wall portion extending upwardly from said tractor scoop bottom wall portion and connected to said pair of tractor scoop side wall portions, said rear wall portion and said pair of side wall portions forming a tractor scoop material receiving portion, a pusher member positioned within said tractor scoop material receiving portion, means for selectively moving said pusher member within said tractor scoop material receiving portion in a substantially horizontal path, first lifting means having an end portion and a second free end portion, said first lifting means positioned in overlying relation with said tractor scoop bottom wall portion with said first lifting means end portion pivotally connected to said tractor scoop rear wall portion, second lifting means having a first end portion and a second end portion, said second lifting means first end portion pivotally connected to said horizontally movable pusher member and said second lifting means second end portion pivotally connected with said first lifting means intermediate said first lifting means end portions, and said second lifting means first end portion being moved substantially horizontally as said pusher member is moved within said tractor scoop material receiving portion to raise said first lifting means second free end portion in an upward arcuate path and move a roof support member positioned on said first lifting means second free end portion into abutting relation with a mine roof.

17. A tractor scoop having a lifting device positioned therein as set forth in claim 16 in which, said second lifting means second end portion pivotally connected with said first lifting means is moved in a vertical arcuate path as said second lifting means first end portion is moved substantially horizontally by said pusher member.

18. A tractor scoop having a lifting device positioned therein as set forth in claim 16 which includes, support means pivotally lifting means second free end portion, said support means supporting a roof support member positioned transverse to a longitudinal axis of said tractor scoop.

* * * * *